US009892718B2

(12) United States Patent
Lambert

(10) Patent No.: US 9,892,718 B2
(45) Date of Patent: Feb. 13, 2018

(54) MUSICAL INSTRUMENT RESTRINGING DEVICE

(71) Applicant: Bruce Lambert, El Segundo, CA (US)

(72) Inventor: Bruce Lambert, El Segundo, CA (US)

( * ) Notice: Subject to any disclaimer, the term of this patent is extended or adjusted under 35 U.S.C. 154(b) by 0 days.

(21) Appl. No.: 15/205,154

(22) Filed: Jul. 8, 2016

(65) Prior Publication Data

US 2018/0012580 A1 Jan. 11, 2018

(51) Int. Cl.

| | |
|---|---|
| ***G10D 7/00*** | (2006.01) |
| ***G10G 7/00*** | (2006.01) |
| ***G10D 3/00*** | (2006.01) |

(52) U.S. Cl.

CPC ..... *G10G 7/00* (2013.01); *G10D 3/006* (2013.01)

(58) Field of Classification Search

CPC ..... G10D 3/006; G10D 3/00

See application file for complete search history.

(56) References Cited

U.S. PATENT DOCUMENTS

| | | | |
|---|---|---|---|
| 3,031,153 | A | 4/1962 | Attwood et al. |
| 3,039,707 | A | 6/1962 | Beck et al. |
| 3,706,254 | A | 12/1972 | Morin |
| 4,151,778 | A | 5/1979 | Beattie et al. |
| 4,791,849 | A | 12/1988 | Kelley |
| 4,796,826 | A | 1/1989 | Pierce |
| 5,272,953 | A | 12/1993 | Koch |
| 5,696,341 | A | 12/1997 | McCane |
| 6,107,556 | A | 8/2000 | Gilliam |
| 6,294,719 | B1 | 9/2001 | Palecki et al. |
| 6,563,037 | B2 | 5/2003 | Hamilton |
| 6,639,137 | B2 | 10/2003 | Lauer |
| 7,534,946 | B1 | 5/2009 | Oxenhandler |
| 7,692,085 | B2 | 4/2010 | Adams |
| 8,278,539 | B1 | 10/2012 | Botz |
| 8,748,717 | B2 | 6/2014 | Mason |
| 9,183,815 | B2 | 11/2015 | Finkle |
| 2003/0037663 | A1 | 2/2003 | Hamilton |
| 2003/0136246 | A1 | 7/2003 | Lauer |
| 2005/0051020 | A1 | 3/2005 | Cenker |
| 2007/0193430 | A1* | 8/2007 | Jang ..... G10D 3/006 84/313 |
| 2009/0038462 | A1 | 2/2009 | Adams |
| 2016/0063972 | A1 | 3/2016 | Finkle |

FOREIGN PATENT DOCUMENTS

| | | | |
|---|---|---|---|
| WO | 1995010829 | A1 | 4/1995 |
| WO | 2000023980 | A1 | 4/2000 |

OTHER PUBLICATIONS

"Action Lowering Inquiry Page" accessible at http://music.stackexchange.com/questions/10328/how-do-i-lower-the-action-on-my-Floyd-Rose-guitar-bridge and viewed on May 12, 2016.

"Ballad Guitar Tuner Page" accessible at http://baopals.com/products/13409972360 and viewed on May 12, 2016.

"Roadie Automatic Guitar Tuner" accessible at https://www.roadietuner.com/ and viewed on May 12, 2016.

* cited by examiner

*Primary Examiner* — Kimberly Lockett

(74) *Attorney, Agent, or Firm* — LeonardPatel PC

(57) ABSTRACT

A restringing device for a stringed instrument may include a guide chuck with one or more guide holes. The restringing device may also include one or more mandrils traversing through the one or more guide holes in a z-direction to restring a string around a tuning peg of the stringed instrument.

16 Claims, 9 Drawing Sheets

300

MUSICAL INSTRUMENT RESTRINGING DEVICE

FIELD

The present invention generally pertains to restringing stringed musical instruments, and more specifically, to restringing a stringed musical instrument with the aid of a mechanical restringing device.

BACKGROUND

In order to restring a stringed instrument, such as a guitar, a significant amount of slack in a new replacement string is initially required, and is subsequently taken up as it is wound around a tuning peg. During the winding step, it is important to maintain tension in the guitar string for several reasons. For example, tension in the guitar string should be maintained to keep a 'ball end' of the guitar string from slipping back within a bridge structure and catching on an end of a string guide (especially for tremolo systems). Also, tension should be maintained in order to create a tight, even winding around the tuning peg, which is located at the headstock of the guitar. If the guitar string catches within the tremolo structure at a point behind the intended stop position or the guitar string is unevenly wound on the tuning peg, the guitar is highly susceptible to detuning while playing/performing.

A skilled guitar technician generally uses both of his or her hands to execute the following three operations: 1) maintain tension on the guitar string; 2) guide the guitar string at the tuning peg during the winding process; and 3) turn the knob on the tuning machine so as to turn the tuning peg, thereby winding the guitar string onto the peg. Not only can this be awkward for a skilled guitar technician, but there can also be a prOPensity for error no matter how many times he or she has restrung a guitar.

As an additional complication, the amount of slack needed at the beginning of the restringing procedure is often difficult to estimate. For example, too little slack results in too few windings around the tuning peg and possible slippage of the guitar string out of the tuning peg during use. Conversely, too much slack may result in overlapping windings, which can slip relative to one another, also causing the guitar to become out of tune.

Thus, an alternative restringing approach may be beneficial.

SUMMARY

Certain embodiments of the present invention may be implemented and provide solutions to the problems and needs in the art that have not yet been fully solved by conventional instrument restringing devices. For example, some embodiments of the present invention generally pertain to an instrument restringing device that efficiently restrings a stringed instrument, such as a guitar, eliminating the problems described above. This restringing device may include mechanical components arranged in such a way that its operation is governed by the physical principles obeyed by mechanical systems (i.e., Newton's Laws). In some embodiments, this restringing device may hold the guitar strings under constant tension throughout the entire restringing operation. This feature allows the guitar technician to have both hands free for guiding and winding the guitar strings around the tuning pegs, for example. Additionally, the restringing device may be prOPerly dimensioned to provide the correct length of string at the beginning of the winding process so as to achieve approximately 3-4 windings around the tuning peg when the process is completed. This feature can effectively remove the guess work from how much slack a person needs to start with.

In one embodiment, a restringing device includes a guide chuck with one or more guide holes. The restringing device also includes one or more mandrils traversing through the one or more guide holes in a z-direction to restring a string around a tuning peg of a stringed instrument such that constant tension is provided to the string during a restringing operation and the restringing operation is performed without a user holding the string.

In another embodiment, a guitar restringing device includes a mandril that lowers through one or more holes within a guide chuck in a z-direction when a user winds a tuning peg to restring a guitar. The lowering of the mandril controls a motion of the replacement guitar string and applies continuous tension to the guitar string as the guitar string lowers through a continuum of positions in the z-direction located above a final equilibrium string position. Upon reaching the final equilibrium string position, the guitar restringing device produces a tension in the guitar string that limits to a predefined value. The guitar restringing device is configured so that one or more guide holes within the guide chuck are positioned above a $12^{th}$ fret and align with a natural position of each guitar string.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are therefore not to be considered to be limiting of its scope, the invention will be described and explained with additional specificity and detail through the use of the accompanying drawings, in which.

DETAILED DESCRIPTION OF THE EMBODIMENTS

Some embodiments generally pertain to a restringing device to facilitate the restringing process for a stringed instrument, such as a guitar. The restringing device as described herein could be used to restring a variety of stringed instruments including, but not limited to, bass guitars, ukuleles, violins, violas, and cellos. The configuration (e.g., physical size, mass of the counterweight, mandril spacing, etc.) of the restringing device may require modifications to accommodate the differences between instruments but the operational principles remain the same. For purposes of explanation, however, the restringing device may be referred to as "guitar restringing device". Some embodiments, the guitar restringing device may provide continuous tension on the replacement string, allowing the guitar technician (hereinafter "user") to use both hands for guiding and winding the guitar string around the tuning peg. This tension may enable a reproducible winding of the guitar string around the tuning peg while simultaneously maintaining constant contact of the ball-end of the guitar string with the bridge string-stop, minimizing stick-slip motion of the tuning peg winding and/or ball that could result in inadvertent detuning of the guitar at a later point in time. The guitar restringing device may exploit mechanical forces and torques to mitigate the problem of diverging string tension toward the end of the winding process that would necessarily occur for a simple fixed-mass-on-pulley or spring loaded design. Variations of the spool cross-sectional shape may be used for creating an arbitrary tension profile for optimized performance and minimization of string stresses due to the guide rollers.

Figure 1:
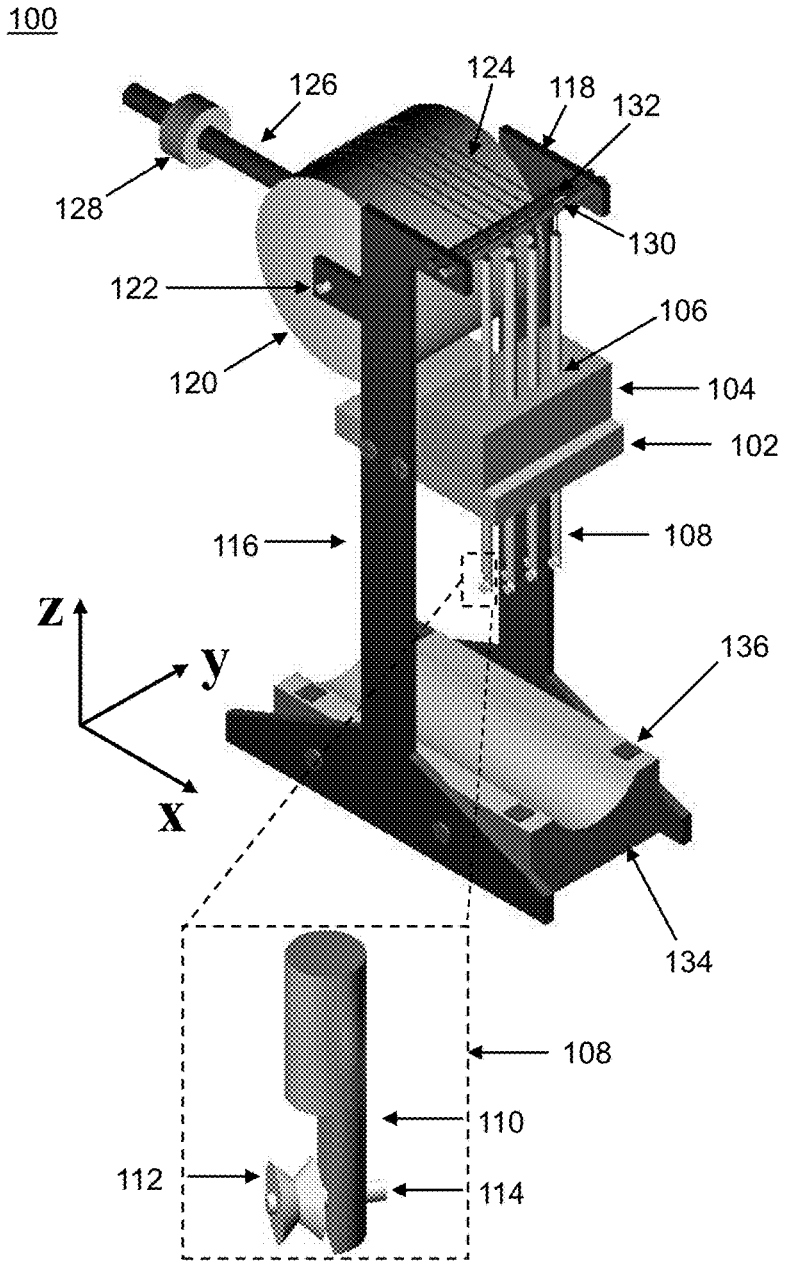
FIG. 1 is a perspective view illustrating a guitar restringing device, according to an embodiment of the present invention.

The guitar restringing device shown in FIG. 1 is used in this example to explain the principles of operation. However, it should be appreciated that many alternative design variations may be envisioned using the principles described herein without deviating from the scope of the invention. For example, the mandrils may be replaced by any suitable mechanical system, such as multiple lever arms, gears, etc., to execute pure (or nearly pure) vertical displacements. Another design variation may facilitate the ability to effect any desired torque profile by changing the cross-sectional shape of the spool, for example.

FIG. 1 is a perspective view illustrating a guitar restringing device 100, according to an embodiment of the present invention. For purposes of explanation, the orientation of guitar restringing device 100 is height (z-direction)×length (x-direction)×width (y-direction). In some embodiments, guitar restringing device 100 may include one or more cylindrical mandrils 108. Although FIG. 1 illustrates a cylindrical mandril 108, it should be appreciated that the shape of the mandril is not limited to a cylinder, but may be any suitable shape without deviating from the scope of the invention. For purposes of this example, cylindrical mandril 108 will be referred to as "mandril". The number of mandrils 108 may vary depending on design requirements. Mandrils 108 may be constrained to motion (or move) along the z- (or vertical) direction via guide holes 106. The number of guide holes 106 in guide chuck 104 may also vary depending on design requirements and may correspond to the number of mandrils 108.

The top of each mandril 108 is connected to a spool 120 via a connecting cable 124. In some embodiments, connecting cables 124 may be made of a flexible but inextensible material, such as nylon rOPe. This way, connecting cables 124 can easily wind about spool 120.

Front roller 130 and back roller 132 may be used to guide connecting cables 124 in some embodiments. This may allow force exerted by each connecting cable 124 on its corresponding mandril 108 to be directed along the z-direction. It should be appreciated that mandrils 108 move in a z- (or vertical) direction, and a majority of connecting cables 124 move in a x- (or horizontal) direction. Front roller 130 and back roller 132 may facilitate redirection of the motion of connecting cables 124 to be along the z-direction. This way, lateral forces on mandril 108 from connecting cable 124 may be eliminated, reducing the likelihood of mandril 108 binding in guide hole 106 as mandril 108 executes vertical displacements. Front roller 130 and back roller 132 may be held up by side support structures 116, 118 such that front roller 130 and back roller 132 can execute free rotation about their y- (or longitudinal) direction.

Spool 120 may be a cylinder having a predefined diameter and may be free to rotate about an axle 122 that is coincident with a symmetry axis of spool 120. Axle 122 may also be held up by side support structures 116, 118. A counterweight rail 126 may be attached to the middle of spool 120 and may protrude from, or extend away from, spool 120 by a predefined distance. In other words, counterweight rail 126 may be perpendicular to spool 120 as illustrated in FIG. 1, for example. In some embodiments, the length of counterweight rail 126 is typically 4 to 6 inches to allow a reasonable range of adjustment for the torque generated by counterweight 128. However, the length of counterweight rail 126 may depend on the size of guitar restringing device 100, the size and weight of counterweight 128, the size of the guitar (not shown), and/or any other factor that would be appreciated by a person of ordinary skill in the art. In some embodiments, counterweight rail 126 supports a counterweight 128, which may slide along the length of counterweight rail 126 to provide a variable counterforce on mandrils 108. Once the optimized counterforce is experimentally determined, counterweight 128 may then be locked into position onto counterweight rail 126 via one or more locking nuts (not shown).

In certain embodiments, the entire mechanical assembly (e.g., guide chuck 104, spool 120, support structures 116, 118, etc.) may be mounted onto a baseplate 102 to provide mechanical rigidity of guitar restringing device 100, for example. Support structures 116, 118 may also function as legs and provide an apprOPriate starting height of mandrils 108 above the guitar (not shown) to be restrung.

Connected to the bottom of each mandril 108, via a roller linkage 110, is a string guide roller 112. Roller linkage 110 may connect to one side of string guide roller 112 via a roller axle 114, allowing the guitar string (not shown) to be hooked, and subsequently unhooked, over string guide roller 112. In some embodiments, string guide roller 112 may be a grooved roller. By having a grooved roller, the guitar string is prevented from slipping off of string guide roller 112 during the winding process. In some embodiments, string guide rollers 112 may have a soft groove surface provided by felt or rubber (not shown) to distribute the force on the guitar string over the surface of string guide roller 112, minimizing string pinching.

Attached to the bottom of (and located in-between) support structures 116, 118 is a guitar neck cradle 134. The guitar to be restrung may be positioned into guitar neck cradle 134 such that mandrils 108 lie directly above the twelfth fret of the guitar. The 'half-pipe' cutout in guitar neck cradle 134 provides a resting surface for the guitar neck that is free of pressure points. The half-pipe may be lined with foam-rubber and/or felt-like material (not shown) in some embodiments to provide increased cushioning for the guitar neck. The half-pipe cutout may also laterally align the guitar neck with respect to mandrils 108 to minimize lateral forces on the guitar string during the winding process. Once the guitar is correctly positioned in guitar neck cradle 134, two thin straps (not shown) may then be placed over and across the guitar neck and secure to tabs 136. In some embodiments, the two thin straps and tabs 136 may be Velcro™. In certain embodiments, the two thin straps and tabs 136 may be connected via a button configuration. This way, the guitar is secured to guitar neck cradle 134, preventing the guitar from 'popping-up' due to the upward mandril force that is generated during the guitar string winding process.

At the end of the restringing process, the straps may be freed from tabs 136, and the straps may then be removed from the interstitial space between the new guitar strings and the fret board. The newly restrung guitar may then be removed from neck cradle 134 for further coarse and fine string tuning adjustments.

During operation, counterweight 128 initially resides at its lowest position (e.g., near baseplate 102), forcing spool 120 to pull mandrils 108 up through guide chuck 104 to their highest position, i.e., string guide rollers 112 may be as close as possible to the underside of baseplate 102. It should be appreciated that this may be the initial position (or first position) prior to beginning the restringing process or prior to attaching the guitar string to string guide rollers 112. As previously described above, the guitar may be positioned in guitar neck cradle 134 such that mandrils 108 lie above the $12^{th}$ fret (e.g., mid-point of a scale length) of the guitar fret board. Although the $12^{th}$ fret is used in this example for restringing the guitar, in other embodiments, the instrument restringing device may be positioned above the mid-point of the instrument's scale length that is equivalent to the $12^{th}$ fret of the guitar. Due to the centering action of guitar neck cradle 134, mandrils 108 automatically align with natural lateral positions of the guitar strings relative to the fret board. See, for example, FIG. 2, which is a top view illustrating a mandril guide chuck 104, and in particular, illustrating the alignment of guide holes 106 relative to the natural positions of the guitar strings, according to an embodiment of the present invention.

Figure 2:
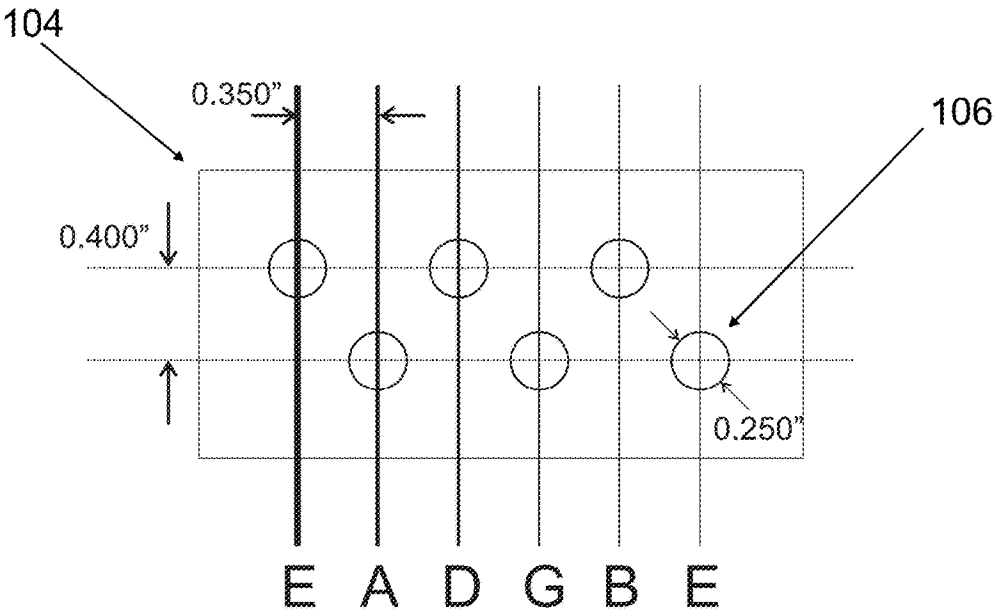
FIG. 2 is a top view illustrating a mandril guide chuck, according to an embodiment of the present invention.

In FIG. 2, the top view of mandril guide chuck 104 shows the relative positioning of mandrils 108 with respect to the natural positions of the six guitar strings whose musical notes are E, A, D, G, B, and E from lowest to highest. In some embodiments, guide chuck 104 is positioned above the $12^{th}$ fret of the guitar, where the spacing between strings (and therefore guide holes 106) is approximately 0.350 inches. The diameter of mandril 108 for certain embodiments may be 0.250 inches. The diameter of guide holes 106 should be slightly larger than the diameter of mandrils 108 to allow a slip fit of mandrils 108 in guide holes 106. It should be appreciated that the spacing between guide holes 106, and also the diameter of guide holes 106, may vary depending on one or more factors. These factors may include, but are not limited to, the type of guitar that is being restrung, the type and size of mandril 108 that is being used, and the size of guitar restringing device 100. Also, as shown in FIG. 2, nearest-neighboring guide holes 106 are staggered to allow for increased room for finger access to string guide rollers 112 for certain embodiments. In other embodiments, the arrangement of guide holes 106 may be in any manner so long as there is room for finger access to string guide rollers 112 and/or there is sufficient spacing between each mandril 108.

Returning to FIG. 1, upon restringing the guitar, the new string is threaded through the bridge (including saddle) structure of the guitar, hooked over string guide roller 112, and the free end is threaded through the tuning peg at the guitar's headstock. In certain embodiments, the $12^{th}$ fret is an important location for mandrils 108 due to the fact that it defines the midpoint between the bridge and nut structure (located at the headstock). In this way, the guitar string may define an isosceles triangle with vertices located at the bridge, the nut, and string guide roller 112. Due to this symmetry, the force exerted by the guitar string onto string guide roller 112 may be in the z-direction, eliminating lateral forces on mandril 108, which could otherwise cause binding of mandril 108 in mandril guide hole 106. It should be appreciated that in some embodiments, there will be an initial force on the guitar string that is determined by the starting angle of counterweight rail 126 with respect to the z-direction and the displacement of counterweight 128 along counterweight rail 126.

As the tuning peg is rotated by turning the tuning peg knob on the guitar, the guitar string begins to wind around the tuning peg, shortening the length of guitar string. This shortening may create tension in the guitar string, which is translated into a vertical force on string guide roller 112, pulling string guide roller 112 and mandril 108 down along the −z-direction. This motion creates a torque on spool 120, which raises the height of counterweight 128 in a continuous manner to a second (or final) position. Throughout the entire winding process, guitar restringing device 100 continually applies an upwardly directed force on the guitar string, maintaining the required tension for an even and reproducible winding about the tuning peg. Further winding of the guitar string around the tuning peg causes corresponding downward motion of mandril 108 and raising of counterweight 128. The downward motion of mandril 108 causes the guitar string to lower through a continuum of vertical positions in the z-direction. At the endpoint of the motion, string guide roller 112 may nearly contact the fret board. At this point, the guitar string is manually unhooked from string guide roller 112, causing mandril 108 to retract vertically due to the force of counterweight 128. The guitar string may then be under the natural tension created by the tuning peg and the bridge (including saddles). The user of guitar restringing device 100 may then make further rotations of the tuning peg to get the guitar string into approximate tune. This process may be repeated on the next string until all strings have been replaced on the guitar. As was discussed above, the continuous tension produced by guitar restringing device 100 not only maintains tension at the tuning peg to create an even winding, but also keeps the ball end of the guitar string up against the bridge stop at all times, preventing the ball end from catching on internal edges within the bridge structure. This is especially important when dealing with floating tremolo bridges. The continuous tension provided by guitar restringing device 100 is one of the several features discussed herein with respect to some embodiments.

Physics of Operation

Figure 3:
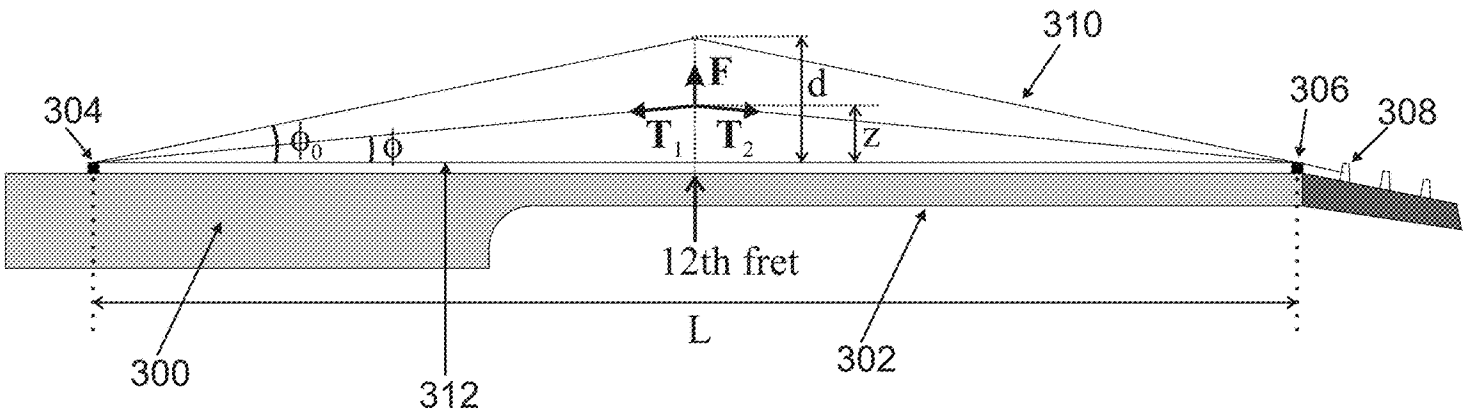
FIG. 3 is a cross-sectional view illustrating a force diagram for the replacement of a string on a guitar, according to an embodiment of the present invention.

The physics of operation with respect to some embodiments are detailed below and, in particular, the tension in the guitar string may be solved for as a function of the rotation angle of the spool (or equivalently as a function of the vertical travel of the mandril). The resulting equation for the guitar string tension as a function of spool rotation angle provides insight into the prOPer mechanical dimensioning of the guitar restringing device components to yield an optimized design. For this analysis, Newton's equations may be used for the force and torque on a mechanical body in static equilibrium. The bold faced letters T, F, x, y, z, and n(θ) represent vector quantities, which possess both a magnitude and a direction. Plain faced letters such as R, L, d, z, and θ represent scalar variables and/or parameters. In some embodiments, the angles are measured in radians. FIG. 3 is a cross-sectional view illustrating a force diagram 300 for the replacement of a guitar string 310 on a guitar 300, according to an embodiment of the present invention. The apex of guitar string 310 starts at a height d above final equilibrium string position 312 above the fret board. As shown in FIG. 3, final equilibrium string position 312 is described by a line segment running along the length of guitar neck 302 with endpoints located at bridge (including saddle) 304 and at nut 306 of the guitar. Final equilibrium string position 312 may lie approximately 0.125 inches above the guitar fret board. With the apex of guitar string 310 located at height d above the $12^{th}$ fret position, guitar string 310 will describe an isosceles triangle that makes an angle denoted $\varphi_0$ with respect to final equilibrium string position 312 at both bridge 304 and nut 306. The forces on guitar string 310 are the two tensions $T_1$ and $T_2$ originating from bridge 304 and nut 306 respectively and the force F exerted by the mandril.

The apex of guitar string 310 starts at a height d above the final equilibrium string position 312 to allow 3 to 4 windings of guitar string 310 about tuning peg 308 at the completion of the winding process. Empirically, height d may be approximately 4 to 5 inches in certain embodiments. As guitar string 310 is wound about tuning peg 308, guitar string 310 lowers toward the final equilibrium string position 312. At an arbitrary point during the winding process, the apex of guitar string 310 is at a height z above final equilibrium string position 312, making an angle φ with respect to final equilibrium string position 312 at both bridge 304 and nut 306 locations. As discussed above, because the $12^{th}$ fret lies halfway between bridge 304 and nut 306, guitar string 310 and final equilibrium string position 312 may define an isosceles triangle at any point during the winding process. The length L of guitar string 310 at its final equilibrium string position 312 between bridge 304 and nut 306 is known as the 'scale length'. It should be appreciated that the scale length may vary by the type of guitar, e.g., for Fender™ guitars, L=25.5 inches, and for Gibson™ guitars, L is slightly shorter at a value of 24.75 inches. The guitar restringing device may allow free rotation of the string guide rollers (see numeral 112 in FIG. 1), equilibrating the guitar string tension on both sides of the apex of guitar string 310. Because of this, tension $T_1$ is equal in magnitude to tension $T_2$. The mandril provides a force F on guitar string 310 that is directed vertically. At any point during the motion, guitar string 310 is very nearly in static mechanical equilibrium so that the vector sum of the forces on guitar string 310 is zero. This condition is stated in vector notation as defined by $$T_1+T_2+F=0 \qquad \text{Equation (1)}$$

Equation (1) may be expressed in two component equations. Due to symmetry and equilibration of the string tensions on both sides of the apex of guitar string 310 due to string guide rollers (see numeral 112 in FIG. 1), the horizontal component expresses nothing more than the equality of the magnitudes of tensions $T_1$ and $T_2$. The vertical component gives the condition for static equilibrium as defined by $$F=2T\sin(\varphi) \qquad \text{Equation (2)}$$

where F and T are the scalar magnitudes of the mandril force and tension in guitar string 310, respectively. Equation (2) may be rearranged into a more illuminating form as $$T=F/[2\sin(\varphi)] \qquad \text{Equation (3)}$$

In Equation (3), for a constant mandril force on guitar string 310, the tension in guitar string 310 approaches infinity as the angle φ goes to zero, i.e., at the end of the winding process. This could be an undesirable situation. For example, large tension on the guitar string due to the winding process may ultimately break the guitar string. Thus, it may be beneficial for the mandril force F to decrease as the angle φ decreases to keep the tension at a level well below the breaking tension of guitar string 310. This force reduction as a function of angle φ cannot be accomplished with a simple counterweight-on-a-pulley design, and certainly may not work using spring tension since the force would actually increase as the angle φ decreases, thereby exacerbating the problem. It will be shown in the subsequent analysis that guitar restringing device 100 of FIG. 1 provides the required force reduction as the guitar string angle φ approaches zero. The reason for this is that even though the counterweight is a fixed value, the torque that this weight generates on the spool varies with the spool rotation angle, causing the guitar string tension to limit to a finite value as angle φ approaches zero.

Figure 4:
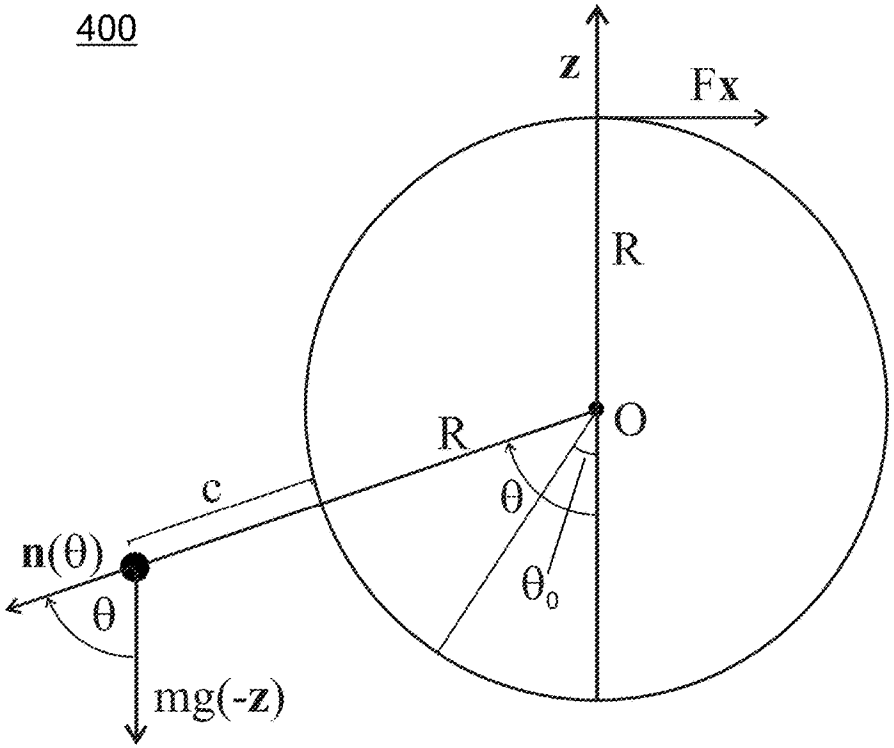
FIG. 4 illustrates a force diagram for a spool, according to an embodiment of the present invention.

FIG. 4 illustrates a force diagram 400 for a cylindrical spool of radius R, according to an embodiment of the present invention. For purposes of explanation, n(θ) is a unit vector that points along the instantaneous direction of the counterweight rail. The gravitational force of the counterweight on the rail has a magnitude equal to the product m·g and points in the −z-direction, where m is the mass of the counterweight in kilograms and g=9.8 (m/s$^2$) is the acceleration due to gravity. In the following analysis, the mass of the counterweight rail is assumed to be negligible in comparison to the counterweight mass m.

In some embodiments, the counterweight of mass m is located at distance c along the counterweight rail, and therefore, lies a total distance of R+c from the axis of rotation of the spool. The axis of rotation runs directly through point O, which is the geometric center of the spool. The torque, due to all forces on the spool, may be evaluated relative to this point.

Furthermore, the selected approach in some of these embodiments measures rotation angles of the spool and counterweight rail relative to the −z-direction. The system is initially configured such that the apex of guitar string 310 lies at distance d (e.g., the maximum distance from final equilibrium string position 312) when the counterweight rail is at angle $\theta_0$. Angle $\theta_0$ is a free parameter that may be selected in optimizing the final design of the guitar restringing device. In some embodiments, however, a constraint may be imposed. For example, when the counterweight rail is vertical (i.e., θ=π radians), the guitar string angle φ may be chosen to equal zero. This means that the arc length on the spool between $\theta_0$ and π must equal the distance d (see FIG. 3) which may be expressed by the following condition:

$$R(\pi-\theta_0)=d \qquad \text{Equation (4)}$$

or equivalently, $$R=d/(\pi-\theta_0) \qquad \text{Equation (5)}$$

As discussed above, d may be a fixed length (e.g., 4 to 5 inches in some embodiments), and upon choosing a starting angle for the counterweight rail, the radius of the spool R can then be solved, i.e., the radius of the spool is determined by the free parameter $\theta_0$.

Referring to FIG. 4, the moment of the forces (i.e. torque) on the spool about the point O may be calculated. It should be noted that there is a force on the spool axle from the support structure, which balances the gravitational force of the counterweight, the gravitational forces of the spool and the counterweight rail, and the force from the mandril. This force is not shown in the diagram, however, since the force applies zero torque about point O. The torque t about a point O, due to a force F that is applied at point P, is given by $$t=r_{OP}\times F=r_{OP}\cdot F\cdot\sin(\gamma)k \quad \text{Equation (6)}$$

where $r_{OP}$ is the position vector pointing from O to P and x represents the vector cross product operation. The operational (useful) definition of the cross product, which is used in the following calculations, is given by the second equality in Equation (6), where the magnitude of the torque t is the product of the magnitudes $r_{OP}$ and F of the vectors $r_{OP}$ and F, respectively, times the sine of the angle γ between these vectors. The direction of the torque is along the unit vector k, which is perpendicular to the plane spanned by vectors $r_{OP}$ and F, and is further specified by the "right-hand-rule" convention. Using this, the torque may be calculated about O due to the counterweight at angle θ, as shown below $$t_{cw}=[(R+c)n(\theta)]\times[(-mg)z]=-mg(R+c)\sin(\theta)y \quad \text{Equation (7)}$$

where m is the mass of the counterweight in (kg) and g=9.8 (m/s$^2$) is the acceleration due to gravity. Similarly, the torque due to the mandril force is given by $$t_{mandril}=(Rz)\times(Fx)=RFy \quad \text{Equation (8)}$$

and in static equilibrium, the sum of the torques is zero, as given by $$t_{cw}+t_{mandril}=-mg(R+c)\sin(\theta)y+RFy=0 \quad \text{Equation (9)}$$

yielding the scalar equation, as shown below $$-mg(R+c)\sin(\theta)+RF=0 \quad \text{Equation (10)}$$

Equation (10) may then be solved out for the mandril force F as given by $$F=mg(R+c)\sin(\theta)/R \quad \text{Equation (11)}$$

The result of Equation (11) may be inserted into Equation (3) to provide the following $$T=mg(R+c)\sin(\theta)/[2R\sin(\varphi)] \quad \text{Equation (12)}$$

Equation (12) is an intermediate result, since angle φ is dependent upon θ. To get Equation (12) solely in terms of the spool rotation angle, the geometry shown in FIG. 3 should be considered. For example, using the Pythagorean Theorem, $$\sin(\phi)=z\Big/\sqrt{z^2+(L/2)^2},$$

and the constraint $d-z=R(\theta-\theta_0)$, which arises from the specific connection of the spool to the mandril, the following equation results:

$$\sin(\phi)=[d-R(\theta-\theta_0)]\Big/\sqrt{[d-R(\theta-\theta_0)]^2+(L/2)^2} \quad \text{Equation (13)}$$

Furthermore, as discussed above, the radius R of the spool is linked to distance d through Equation (5). By this very reason, Equation (13) may be rewritten as $$\sin(\phi)=\frac{d[1-(\theta-\theta_0)/(\pi-\theta_0)]}{\sqrt{d^2[1-(\theta-\theta_0)/(\pi-\theta_0)]^2+\left(\frac{L}{2}\right)^2}} \quad \text{Equation (14)}$$

The result from Equation (14) may be used in Equation (12), and simplifying terms gives the desired result for the guitar string tension as a function of spool rotation angle θ and the device design parameters m, c, d, and $\theta_0$.

$$T(\theta;m,c,d,\theta_0)=\frac{mg}{2d}(\pi-\theta_0)^2\left(\frac{d}{(\pi-\theta_0)}+c\right)\sqrt{\left(\frac{\pi-\theta}{\pi-\theta_0}\right)^2+\frac{L^2}{4d^2}}\,\frac{\sin(\theta)}{(\pi-\theta)} \quad \text{Equation (15)}$$

Equation (15)

One may evaluate this expression at the vertical position θ=π and show that the tension limits to the finite value shown in the equation below:

$$T(\theta=\pi;m,c,d,\theta_0)=\frac{mg}{4d^2}(\pi-\theta_0)^2\left(\frac{d}{(\pi-\theta_0)}+c\right)L \quad \text{Equation (16)}$$

where we have used the fact that sin(θ)/(π−θ) limits to 1 as θ approaches π. The parameters in this expression may be adjusted to give a reasonable value for the guitar string tension at the end of the winding process.

If more adjustability is required, one may replace the cylindrical spool with a spool with a non-circular cross section. This may provide modulation of the torque due to the mandril force F on the spool, arising from the changing geometrical relationship between r and F throughout the rotational displacement of the spool. This way, both the magnitudes and directions of r and F can be varied by changing the cross-sectional shape of the spool, allowing nearly any desired string tension profile T(θ).

Additional Embodiments

Figure 5A:
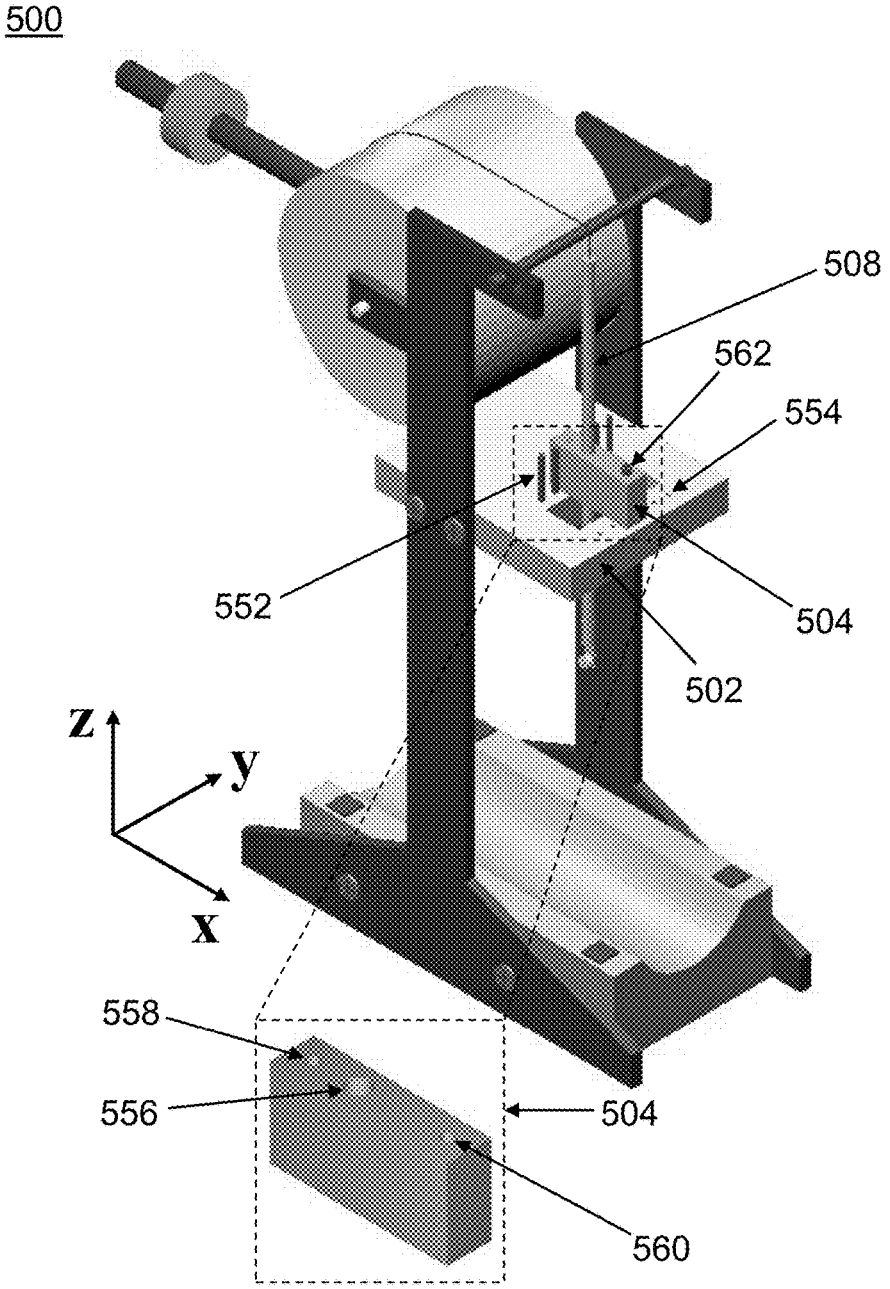
FIG. 5A is a perspective view illustrating a guitar restringing device, according to an embodiment of the present invention.

FIG. 5A is a perspective view illustrating a guitar restringing device 500, according to an embodiment of the present invention. In some embodiments, baseplate 502 may include six alignment pegs 552, which protrude upward (or outward). In some further embodiments, alignment pegs 552 may be spaced at 0.350 inches from one another. It should be noted, however, that the alignment may change depending on the size of the guitar and the spacing between the guitar strings for a particular type and/or model of guitar, for example. This may allow each alignment peg 552 to be aligned with the transverse spacing of the guitar strings relative to the fret board. Directly opposite to each alignment peg 552 is a corresponding threaded hole 554 in baseplate 502. This may allow alignment pegs 552 and corresponding threaded holes 554 to define six discrete positions for guide chuck 504. In such embodiments, guide chuck 504 may include a single mandril guide hole 556, a peg locating hole 558, and a bolt hole 560.

During operation of guitar restringing device 500, guide chuck 504 (with mandril 508 inserted into guide hole 556) may be manually lowered onto one of six alignment pegs 552. This may allow each alignment peg 552 to fit through peg locating hole 558 in guide chuck 504. With guide chuck 504 flush to baseplate 502, guide chuck 504 may then be rotated about alignment peg 552 until bolt hole 560 aligns with threaded hole 554 in baseplate 502 opposite to alignment peg 552. A bolt 562 in some embodiments is dropped through bolt hole 560 and then screwed into threaded hole 554 of baseplate 502 to lock guide chuck 504 into position. As stated earlier, alignment pegs 552 may be positioned on baseplate 502 to ensure that, at each position for guide chuck 504, mandril 508 will lie above the corresponding natural guitar string position. See, for example, FIG. 2. It should be appreciated that changing of the guitar string proceeds in the same manner as discussed above. To change the next string, the user may simply move the assembly, which includes guide chuck 504 and mandril 508, to the next position and repeat until all of the guitar strings are changed.

Although not illustrated, in an alternative and/or equivalent embodiment, guide chuck 504 may include a single peg, and baseplate 502 may include six peg locating holes. This may allow the single peg of guide chuck 504 to fit into any one of six locating holes in baseplate 502, and cause mandril 508 to align with the natural guitar string positions illustrated in FIG. 2, for example.

Figure 5B:
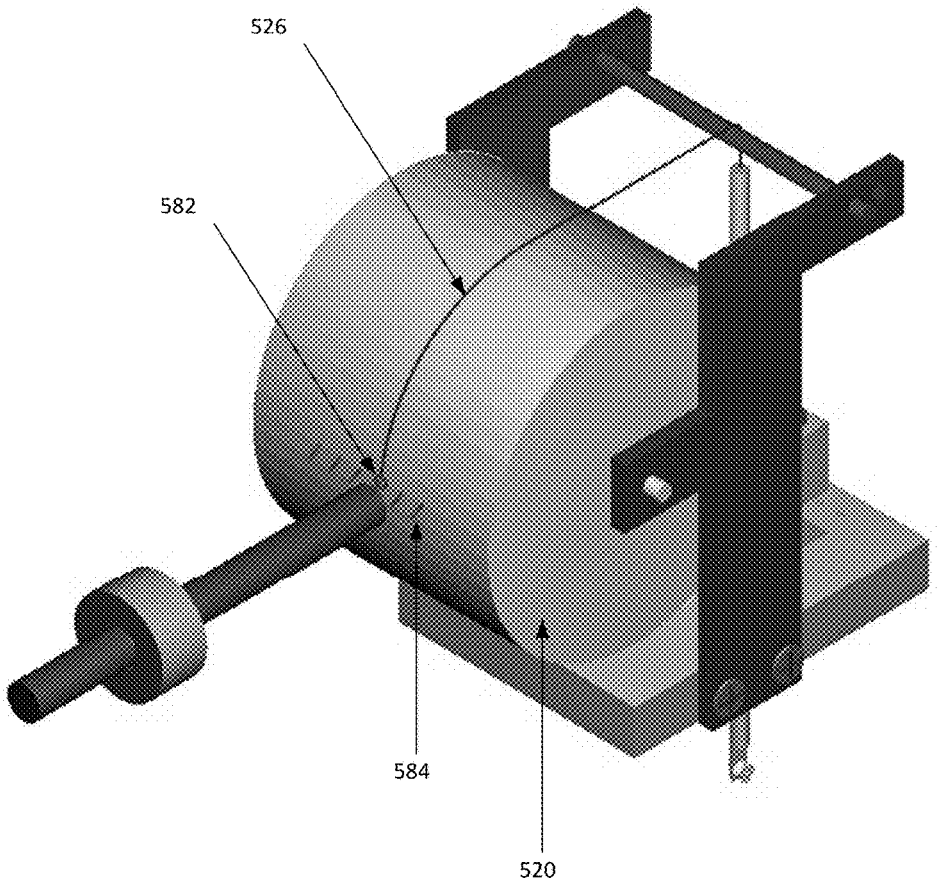
FIG. 5B is a perspective view illustrating a spool of the guitar restringing device of FIG. 5A, according to an embodiment of the present invention.

Upon moving the position of guide chuck 504, the position of connecting cable 526 may change as well. See, for example, FIG. 5B, which is a perspective view illustrating a spool 520 of guitar restringing device 500 of FIG. 5A, according to an embodiment of the present invention. To accommodate movement of connecting cable 526, six downwardly angled pins 584 are attached to the back of spool 520. The end of connecting cable 526 terminates in a hoop 582, and upon moving to the next mandril position, hoop 582 is unhooked from pin 584 and moved over to the next pin position on spool 520. It should be appreciated that the hoop and pin configuration discussed above for attaching connecting cable 526 to spool 520 is one of many possible embodiments for attaching connecting cable 526 to a position on the back of spool 520.

In some embodiments, binding of mandril 508 in mandril guide hole 556 may prove to be a problem. Binding of mandril 508 during the restringing operation can be reduced by choice of material (e.g. Teflon™) for guide chuck 504 and by chamfering the edges of mandril guide hole 556.

Figure 5C:
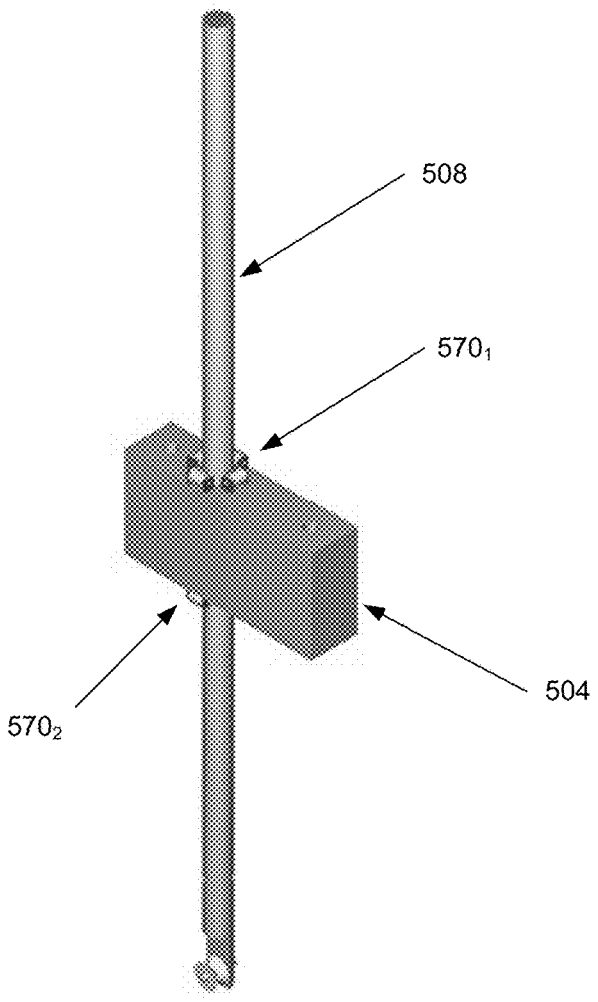
FIG. 5C is a perspective view illustrating a mandril and a guide chuck of the guitar restringing device of FIG. 5A, according to an embodiment of the present invention.
Figure 5D:
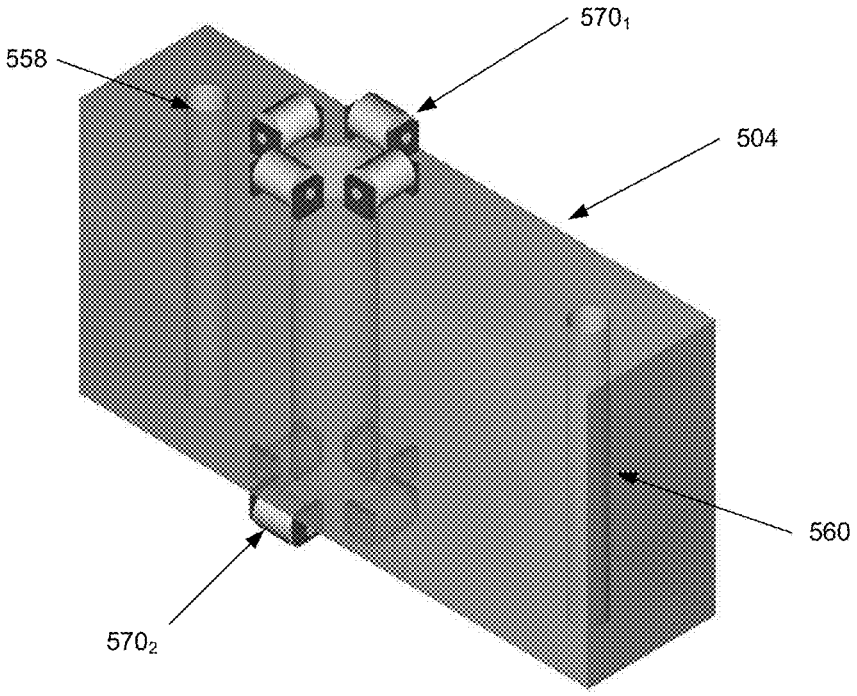
FIG. 5D is a perspective view illustrating a guide chuck of the guitar restringing device, according to an embodiment of the present invention.

To further resolve such issues, FIG. 5C is a perspective view illustrating a mandril 508 and a guide chuck 504 of guitar restringing device 500 of FIG. 5A, according to an embodiment of the present invention. In these embodiments, guide chuck 504 may include guide-roller bearings $\mathbf{570}_1$, $\mathbf{570}_2$, which may be a more robust solution to the mandril binding problem. See, for example, FIG. 5D, which is a perspective view of guide chuck 504, according to an embodiment of the present invention. In some embodiments, mounted to the top surface of guide chuck 504 is a set of guide-roller bearings $\mathbf{570}_1$. Furthermore, a complementary set of guide-roller bearings $\mathbf{570}_2$ may be mounted to the bottom surface of guide chuck 504, or in some embodiments, beneath baseplate 502 (not shown) to allow mandril 508 to pass through in a slip-fit fashion. Returning to FIG. 5C, with no forces applied to mandril 508, the clearance between the cylindrical surface of mandril 508 and each roller bearing $\mathbf{570}_1$ and/or $\mathbf{570}_2$ should be no more than 0.002" in some embodiments, ensuring a slip-fit of mandril 508 with respect to guide-roller bearings $\mathbf{570}_1$, $\mathbf{570}_2$.

During operation, mandril 508 may execute a motion primarily along the z-direction. However, in general, small lateral forces may exist on mandril 508 from the guitar string as well as from connecting cable 526. These forces may tip and tilt mandril 508, creating contact points between mandril 508 and one or more surfaces of guide-roller bearings $\mathbf{570}_1$, $\mathbf{570}_2$. The frictional forces between mandril 508 and guide-roller bearings $\mathbf{570}_1$, $\mathbf{570}_2$ may then create rotational motion of bearings $\mathbf{570}_1$, $\mathbf{570}_2$, translating into nearly friction-free motion of mandril 508 along the z-direction. Inclusion of the guide-roller bearing system into the simple guide chuck configuration may significantly reduce the number of possible contact surfaces between mandril 508 and guide chuck 504 for nearly friction-free motion along the z-direction. However, the configuration may involve more moving parts and may be more complex to fabricate, increasing the manufacturing cost of guitar restringing device 500.

It should be appreciated that when mandril 508 reaches its lowest vertical position along the z-direction during the restringing process, mandril 508 may be unable to physically move any lower. If, for example, the user is unaware that mandril 508 has reached its lowest position, and the user continues to wind the guitar string around the tuning peg, the tension in the guitar string may quickly rise, causing the guitar string to break and/or cause damage to the restringing device. Thus, in some embodiments, guitar restringing device 100 and/or 500 may include a depth monitoring system 540 that alerts the user when mandril 508 is near or at its lowest position. See, for example, FIG. 5E, which is a perspective view of a depth monitoring system 540 integrated with guitar restringing device 500, according to an embodiment of the present invention.

In some embodiments, depth monitoring system 540 may include a mechanical slider 550 attached to mandril 508, an electric switch 541 attached to the top of guide chuck 504, and associated leads 542 connecting a power source 546 to an alarm unit 544. Depending on the embodiment, alarm unit 544 may include an audio source, an optical source, or both. With mandril 508 at its highest position (i.e., at the beginning of the restringing operation), electric switch 541 is open and alarm unit 544 is inactive. As mandril 508 reaches a predetermined depth, i.e., when mandril 508 is near its lowest position, electric switch 541 closes. This may cause alarm unit 544 to activate, alerting the user that the restringing process for mandril 508 is nearly complete. In certain embodiments, electric switch 541 may remain closed, causing alarm unit 544 to remain active for all mandril depths below the switching depth or until the user resets electric switch 541.

Figure 5E:
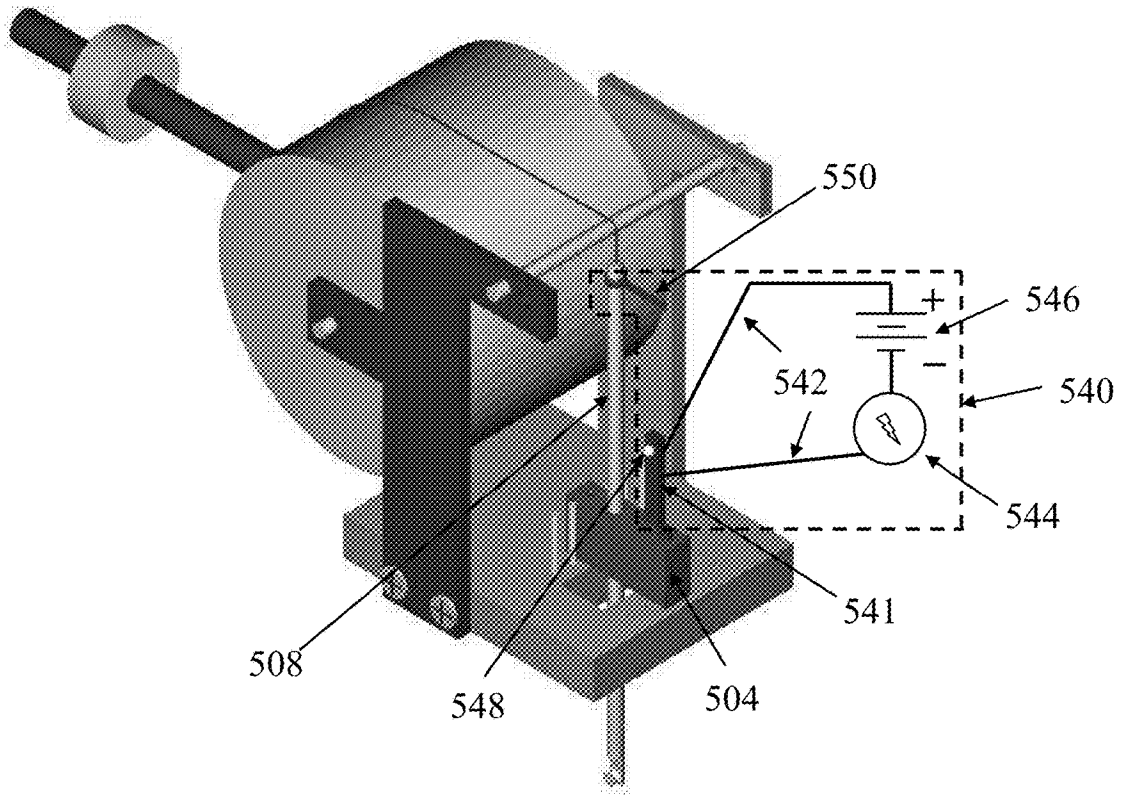
FIG. 5E is a perspective view illustrating a depth monitoring device of the guitar restringing device, according to an embodiment of the present invention

In FIG. 5E, guide chuck 504 is outfitted with an electrical switch 541, for which electrical contact between the two leads 542 of electric switch 541 is engaged (and disengaged) by mechanical actuation of a switch button 548. Electric switch 541 in certain embodiments may be of a latching type. For example, actuation of switch button 548 may engage electrical contact between two leads 542, where switch button 548 maintains electrical connection between leads 542 until switch button 548 is actuated again. One of leads 542 for electric switch 541 may connect to the positive terminal of power source 546 and the other lead 542 may connect to an alarm unit 544. The circuit may be completed by connecting the remaining electrical lead of alarm unit 544 to the negative terminal of power source 546.

In addition, attached to the top of mandril 508 is a mechanical slider 550. As the guitar is being restrung, mandril 508 and attached slider 550 lower together in depth. When mandril 508 reaches a predetermined depth that is less than the maximum vertical travel for mandril 508, slider 550 makes physical contact with switch button 548, engaging electrical connection between leads 542. Electrical current is then delivered to alarm unit 544, creating an audio signal (and/or optical flashing signal in some embodiments) alerting the user that mandril 508 is close to its maximum travel. The alarm may remain active until the user manually resets electric switch 541 by actuating switch button 548. It should be appreciated that switch button 548 may be an optically actuated switch button in some embodiments. In those embodiments, a mechanical slider may interrupt an optical beam causing switch leads 542 to electrically connect.

It will be readily understood that the components of various embodiments of the present invention, as generally described and illustrated in the figures herein, may be arranged and designed in a wide variety of different configurations. Thus, the detailed description of the embodiments of the systems, apparatuses, methods, and computer programs of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A restringing device, comprising:

a guide chuck with one or more guide holes; and one or more mandrils traversing through the one or more guide holes in a z-direction to restring a string around a tuning peg of a stringed instrument such that continuous tension is provided to the string during a restringing operation and the restringing operation is performed without a user holding the string.

2. The restringing device of claim 1, wherein an initial position of the one or more mandrils causes the string to be positioned at an initial height located above a final equilibrium string position, allowing for a predefined number of windings about the tuning peg.

3. The restringing device of claim 2, wherein as the one or more mandrils traverse in the z-direction through the one or more guide holes, the string lowers through a continuum of positions in the z-direction located above the final equilibrium string position.

4. The restringing device of claim 3, wherein the lowering of the one or more mandrils to any height between the initial height and the final equilibrium string position causes the string to create an apex such that the string forms an angle $\varphi$ with respect to the final equilibrium string position at both a bridge saddle of the stringed instrument and at a nut of the stringed instrument.

5. The restringing device of claim 1, further comprising:

a string guide roller connected to a lower end of each of the one or more mandrils, wherein the string guide roller is configured to constrain a motion of an apex of the string to be along the z-direction and to allow the string to be hooked onto the string guide roller prior to restringing of the stringed instrument and subsequently unhooked from the string guide roller upon completion of the restringing of the stringed instrument.

6. The restringing device of claim 1, further comprising:

a counterweight rail comprising a counterweight, the counterweight rail protruding out of a spool by a predefined length, wherein the counterweight provides a counterforce on the one or more mandrils.

7. The restringing device of claim 6, wherein the counterweight initially resides at a first position to force the spool to pull the one or more mandrils up in a z-direction or vertical direction through the one or more guide holes defining an initial position for the string.

8. The restringing device of claim 6, wherein winding of the string around the tuning peg induces a shortening of the string, creating a force in the negative z-direction on the one or more mandrils to pull the one or more mandrils along a negative z-direction.

9. The restringing device of claim 8, wherein the force creates a torque on the spool via one or more connecting cables, raising the counterweight to a final position.

10. The restringing device of claim 6, further comprising:

one or more connecting cables connecting the spool to the one or more mandrils, wherein the one or more connecting cables are affixed to one or more corresponding mechanical attachment points on the spool.

11. The restringing device of claim 1, wherein the guide chuck is positioned above a mid-point of a scale length of the stringed instrument, the stringed instrument being placed within an integrated neck cradle, allowing for alignment of the one or more mandrils with corresponding natural string position of each string relative to a fret board.

12. The restringing device of claim 1, wherein the guide chuck comprises a first set of guide-roller bearings mounted to a top surface of the guide chuck and a second set of guide-roller bearings mounted to a bottom surface of the guide chuck, and the first set of guide-roller bearings and the second set of guide-roller bearings prevent the one or more mandrils from binding in the one or more guide holes as the one or more mandrils execute z directed or vertical displacements.

13. The restringing device of claim 1, further comprising:

a depth monitoring system configured to alert a user operating the restringing device that the one or more mandrils is at or near a lowest position for the one or more mandrils.

14. The restringing device of claim 13, wherein the depth monitoring system comprises a mechanical slider, and when the mechanical slider attached to the one or more mandrils contacts the depth monitoring system, an electrical current is delivered to an alarm unit of the depth monitoring device creating an audio signal, a visual signal, or both, alerting the user that the one or more mandrils is near or proximate to the lowest position for the one or more mandrils.

15. The restringing device of claim 1, wherein when the string is at a final equilibrium string position, the tension reaches a predefined value, the predefined value being less than a value for breaking the guitar string.

16. A guitar restringing device, comprising:

a mandril lowering through one or more guide holes within a guide chuck in a z-direction when a user winds a tuning peg to restring a guitar, wherein lowering of the mandril controls a motion of the guitar string and applies continuous tension to the guitar string as the guitar string lowers through a continuum of positions in the z-direction located above a final equilibrium string position, upon reaching the final equilibrium string position, the guitar restringing device produces a tension in the guitar string that limits to a predefined value, and the one or more guide holes within the guide chuck are positioned above a $12^{th}$ fret and aligned with a natural position of each guitar string.

* * * * *